US005204028A

United States Patent [19]

Ruston

[11] Patent Number: 5,204,028

[45] Date of Patent: Apr. 20, 1993

[54] CLAMP FOR AERATION DOME

[75] Inventor: George H. Ruston, Boxford, Mass.

[73] Assignee: Aeration Engineering Resources Corporation, Worcester, Mass.

[21] Appl. No.: 935,093

[22] Filed: Aug. 25, 1992

[51] Int. Cl.[5] ..... B01F 3/04

[52] U.S. Cl. ..... 261/122.1

[58] Field of Search ..... 261/122.1

[56] References Cited

U.S. PATENT DOCUMENTS

| | | | |
|---|---|---|---|
| 3,279,773 | 10/1966 | Schwartz | 261/122.1 |
| 3,532,272 | 10/1970 | Branton | 261/122.1 |
| 3,768,788 | 10/1973 | Candel | 261/122.1 |
| 4,007,240 | 2/1977 | Gosden | 261/122.1 |
| 4,012,470 | 3/1977 | Thayer | 261/122.1 |
| 4,046,845 | 9/1977 | Veeder | 261/122.1 |
| 4,288,394 | 9/1981 | Ewing | 261/122.1 |
| 4,889,620 | 12/1989 | Schmit et al. | 261/122.1 |

FOREIGN PATENT DOCUMENTS

| | | | |
|---|---|---|---|
| 348125 | 9/1960 | Switzerland | 261/122.1 |

*Primary Examiner*—Tim Miles

*Attorney, Agent, or Firm*—Shlesinger Arkwright & Garvey

[57] ABSTRACT

A clamp structure is shown for holding a ceramic aeration dome firmly seated on its molded polyvinyl saddle mounting means disposed at the bottom of an aeration tank filled with a liquid to be aerated.

6 Claims, 1 Drawing Sheet

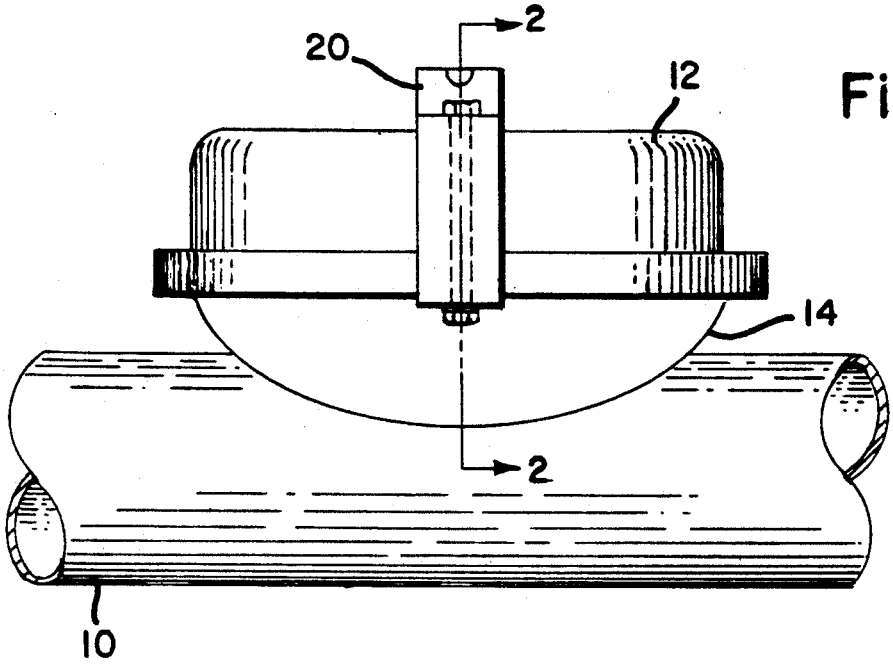
Fig.1
Fig.2
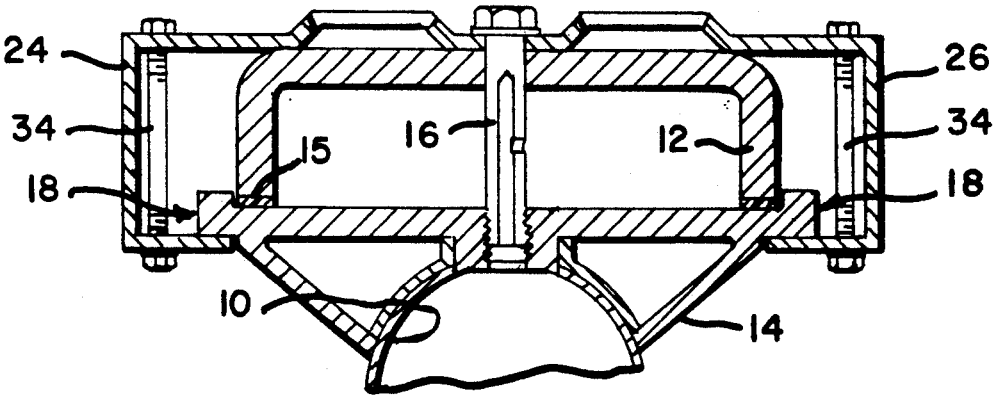
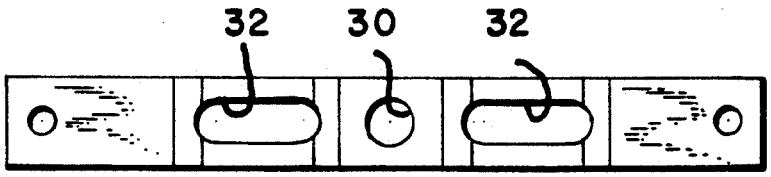
Fig.3

CLAMP FOR AERATION DOME

This invention is concerned with a clamp for use with a ceramic diffuser dome mounted in an aeration system for treatment of wastewater. More particularly it provides a mechanical clamping means for the elimination of air leakage at the sealing surface and the loss of air pressure under the dome situated in the aeration tank of said system wherein the dome is typically supported on a molded plastic saddle that is cemented to a plastic air distribution piping means.

BACKGROUND STATEMENT

In many aeration systems, porous ceramic domes are used to generate a large quantity of minute air bubbles that rise to the surface of the liquid being aerated in the waste water tank. There are usually a large number of similar domes mounted on molded polyvinyl chloride (PVC) saddle shaped mounting structures mounted in place on the top of the air pipe distribution system. These domes are usually distributed evenly across the bottom of the tank as is well know in the art.

In many of these wastewater treatment facilities, the air piping distribution systems are fabricated in plastic, usually of PVC piping with molded PVC saddle structures cemented to the air distribution pipes upon which the ceramic domes and their sealing gaskets are mounted. It has been found in some systems that after some period of use, that some of the saddle mounting supports become warped and allow an undue amount of the air that is pumped to these domes under some pressure, to escape in the form of large bubbles that are less oxygen efficient in the aeration process. Furthermore such leakage from under the domes, reduces the air pressure under the dome to render these domes less effective for the production of the required diffusion of small air bubbles that are required for the aeration process.

It has been noted that the portions of the PVC mounting saddles that are directly over the air distribution pipe to which they are cemented, are rather rigidly supported in place but the outside portions of the saddle structures that are spread out sidewise from the supporting pipe upon which the saddles are mounted, over some period of time, some of these outer sections tend to become warped downwardly thus pulling away from the rigid dome bolted at its center onto those domes. It has been found, due to this slight warpage in some of the saddle mounting means, that sufficient air has been allowed to escape from the formerly sealed air chamber formed under the dome mounted on those saddle means to interfere with the proper aeration of the liquid in the tank.

Typical prior art structures are shown in the following United States patents:

U.S. Pat. No. 3,532,272 to Branton, Oct. 6 1970, discloses the type of saddle mounting for which the present invention is particularly provided.

Other mounted ceramic aeration structures are shown in:

| | | |
|---|---|---|
| 3,768,788 | to Candel | Oct. 30, 1973; |
| 4,007,240 | to Gosden | Feb. 8, 1977; |
| 4,046,845 | to Veeder | Sept. 6, 1977; |
| 4,788,394 | to Ewing et al | Sept. 8, 1981. |

BRIEF DESCRIPTION OF THIS INVENTION

Individual clamping devices are shown herein that extend diametrically across each one of the individual ceramic domes at about a right angle to the length of the respective air distribution pipe upon which the several domes are mounted. These clamping devices take the form of a rigid bar mounted in proximity to each one of the domes but each such bar is spaced above its dome in a position not to interfere with the free flow of the aeration bubbles emanating from the dome on the saddle over which it is mounted. The opposite ends of each of the clamping bars are provided with C shaped elements that are adapted to be closed over the edge of the dome and to be engaged underneath the edge of its plastic saddle mounting means to hold the formerly warped portions of the plastic saddle mounting means pressed tightly against the seal that engages against the bottom perimeter of the rigid ceramic domes.

IN THE DRAWINGS

FIG. 1 is a vertical side elevation showing a clamping bar of this invention mounted on a ceramic dome carried on a saddle in a typical aeration system;

FIG. 2 is a view taken on the plane 2—2 of FIG. 1; and

FIG. 3 is a top plan view of the clamping bar.

DETAILED DESCRIPTION

One of the many such aeration domes mounted on the bottom of an aeration tank full of a liquid to be aerated is shown in FIG. 1. Typically, a system of polyvinyl chloride ( PVC ) pipes 10 are provided to distribute air to the many porous ceramic domes positioned on the bottom of the tank, one such dome 12 being shown. These domes are porous rigid inverted bowl shaped elements made of a molded and fired ceramic composition and each dome is supported on a suitable saddle support 14.

These mounting saddles are each conventionally made of a molded PVC that is a substantially rigid structure. The saddles are fixed onto the air distribution pipes with a cement and each saddle has a seat formed integral therein to receive the downwardly facing perimeter of the dome that is mounted thereon. The domes are mounted in air tight contact on the neoprene dome gaskets 15 fitted between the seat and the perimeter of the dome by a hollow bolt 16 in the known manner to receive air under pressure delivered through the air distribution conduits 10. The air is forced through the porous domes to be issued as small bubbles to be distributed evenly throughout all of the liquid in the aeration tanks.

Each saddle has a substantially rigid support above the conduit 10 at its center where the saddle straddles that conduit but the outer edges portions of the saddles that are spread wide from the conduit that are indicated by the arrows 18 in FIG. 2, are not so rigidly supported. In some instances, these portions 18 of the molded plastic saddles have, after a period-of time in use, become warped to such an extent that the seal between the periphery of the dome is not sufficiently tight against gasket 15 in its seat on the saddle mounting such that air pressure within the dome has been allowed to escape in the form of large bubbles that do not serve to efficiently aerate the liquid in the tank.

To cure this defect in the use of molded plastic saddles, that ultimately show signs of warpage, the herein disclosed clamping bar is provided. This bar is a rigid stainless steel construction 20, one of which is adapted to be attached to the each of the individual warped domes mounted on the bottom of the aeration tank. The clamp bar is shaped to be engaged over the top of the dome by the bolt 16 that holds the dome sealed tightly against the seal 15 in its seat on the saddle, the bolt supporting the clamp bar in a position to extend diametrically across over the top of the dome above which it is mounted. The clamp bar is situated to be in a position that is at right angles to the direction of the conduit 10 upon which the saddle is mounted.

The outer ends 24 and 26 of the clamp bar as shown in FIG. 2 are each shaped like a C and the bar has a length such that the C shaped ends can be engaged in contact with the dome and the saddles at the widely spaced positions 18 as shown in FIG. 2. The main body portion of the clamp bar is shaped to be spaced above the top side of the dome 12 and is preferably apertured as shown at 30 in FIG. 3 to be engaged under the head of the bolt 16. The bar is shaped to be spaced away from contact with the exposed outer surface of the dome and the surface of the clamp bar may be apertured as indicated by reference 32 to permit the free flow of air bubbles from the top of the dome into the liquid being aerated.

Each of the C shaped ends is designed to be placed in contact with the dome as shown in FIG. 2. The lips at the ends of the mouth of the C shaped clamp means at each end of the clamp bar are positioned to be engaged over the top edge of the dome over which it is mounted and under the exposed under side of the saddle at the diametrically opposite points 18. The upper and lower arms of each of the C shaped ends are engaged by a bolt 34 so that they can be drawn tightly together to firmly clamp the outer edges 18 of the saddle tightly against the seal 15 and the rigid peripheral edge of the dome 12. When the bolts are tightened gently to complete the clamping action, the effect of any warpage of the molded polyvinyl chloride saddle is overcome and any possibility of leakage of air from inside the dome is eliminated.

While the above is a description of the preferred form of this invention, it is possible that modifications thereof may occur to those skilled in the art that will fall within the scope of the following claims.

I claim:

1. A clamp for use with a circular ceramic aeration dome mounted on an annular seat integral with a molded plastic saddle supported over an air supply pipe that extends in a line along the bottom in a liquid aeration tank, said clamp comprising an elongated body portion extending over and being spaced above said dome, said body having a length longer than the diameter of said circular dome, said body being shaped to have integral C shaped ends, said ends each being adapted to engage said plastic saddle underneath said annular seat at diametrically opposite points, said body being disposed at approximately a right angle to the direction of the line along which said supply pipe extends, and means to forcibly engage said C shaped ends against the underside of said plastic saddle to hold said dome firmly sealed in said seat of the saddle.

2. A clamp as in claim 1 wherein said dome is mounted on said saddle by a centrally disposed bolt, and said body has a depressed central portion, and said central portion is apertured to be engaged by said bolt.

3. A clamp as in claim 2 wherein said body is formed of a flat strip of stainless steel and said portions of said body that are spaced above said dome are apertured.

4. A clamp as in claim 1 wherein said means to forcibly engage said dome in said seat are bolts that extend across the mouths of the respective C shaped ends.

5. A clamp as in claim 1 wherein said C shaped ends engage the top sides of said domes at said diametrically opposite points.

6. A clamp as in claim 5 wherein said means to forcibly engage said domes in said seat are bolts that extend across the mouths of the respective C shaped ends.

* * * * *